US005621169A

United States Patent [19]

Harris et al.

[11] Patent Number: 5,621,169

[45] Date of Patent: Apr. 15, 1997

[54] METHOD FOR DETERMINING HYDROCARBON/WATER CONTACT LEVEL FOR OIL AND GAS WELLS

[75] Inventors: Thomas G. Harris; Donald L. Luffel; Joseph M. Hawkins, all of Houston, Tex.

[73] Assignee: Restech, Inc., Houston, Tex.

[21] Appl. No.: 710,085

[22] Filed: Sep. 10, 1996

Related U.S. Application Data

[63] Continuation of Ser. No. 592,608, Jan. 26, 1996, abandoned, which is a continuation of Ser. No. 182,450, Jan. 18, 1994, abandoned.

[51] Int. Cl.[6] ..... E21B 47/04

[52] U.S. Cl. ..... 73/152.18; 364/422

[58] Field of Search ..... 73/152.18, 152.55, 73/64.55; 364/422

[56] References Cited

U.S. PATENT DOCUMENTS 4,903,207 2/1990 Alger et al. ..... 364/422

OTHER PUBLICATIONS

Journal of Petroleum Technology—Thomeer, J.H.M., "Introduction of a Pore Geometrical Factor Defined by the Capillary Pressure Curve", Mar. 1960 pp. 73–77.

JPT, Swanson, B.F., "A Simple Correlation Between Permeabilities and Mercury Capillary Pressures", Dec. 1981, pp. 2,498–2,504.

World Oil—Smith, D. "How to Predict Down–Dip Water Level", May 1992, pp. 85–88.

AAPG Bulletin—Pittman, E.D., "Relationship of Porosity and Premeability to Various Parameters Derived from Mercury Injection Capillary Pressure Curves for Sandstone", vol. 76, No. 2, Feb. 1992, pp. 191–198.

*Primary Examiner*—Michael Brock

*Attorney, Agent, or Firm*—Bush, Riddle & Jackson, L.L.P.

[57] ABSTRACT

A method for predicting the hydrocarbon/water contact level for oil and gas wells which relates porosity $\phi$, water saturation $S_w$, air permeability $k_a$, and capillary pressure $P_c$. Such contact level may be estimated without actual capillary pressure measurements. The method relies on a worldwide correlation of permeability and porosity to a function of capillary pressure. The hydrocarbon/water contact levels are predicted through regression analysis using porosity $\phi$, water saturation $S_w$, and air permeability $k_a$ from well log and core analysis information. Relationships used in this method include $$\log P_c = -F_g/\ln(1 - S_w) + \log P_d, \quad \text{(a)}$$

$$F_g = \left[ \ln\left( 5.21 \frac{k_a^{0.1254}}{\phi} \right) \right]^2 /2.303, \quad \text{(b)}$$

$$P_d = 937.8/(k_a^{0.3406})\,\phi, \text{ and} \quad \text{(c)}$$

$$h = \frac{P_c}{0.433\,(p_w - p_h)} \quad \frac{(\sigma_r \cos\theta_r)}{\sigma_i \cos\theta_i},$$

where $P_c$ is mercury capillary pressure, $F_g$ is pore geometrical factor, $S_w$ is water saturation, $P_d$ is mercury displacement pressure, $k_a$ is air permeability, and $\phi$ is porosity. The constants set forth in equations (b) and (c) above may be adjusted to fit measured data from rock samples within the reservoir.

3 Claims, 6 Drawing Sheets

METHOD FOR DETERMINING HYDROCARBON/WATER CONTACT LEVEL FOR OIL AND GAS WELLS

This application is a continuation of application Ser. No. 08/592,608 filed on Jan. 26, 1996 now abandoned which was a continuation of application Ser. No. 08/182,450 filed on Jan. 18, 1994 now abandoned.

FIELD OF THE INVENTION

This invention relates to a global method for predicting the hydrocarbon/water level for oil and gas wells, and more particularly to such a method which predicts such level from routine log data derived parameters of porosity, water saturation, and air permeability.

BACKGROUND OF THE INVENTION

When exploring for or developing new oil and gas reservoirs, the borehole of a well high on a structure may not penetrate the hydrocarbon/water contact. This contact level should be determined to locate delineation wells, plan development drilling, and forecast reserves and economics, especially when operating in high-cost areas.

In principal, hydrocarbon/water levels can be predicted from a combination of capillary pressure data, and log or core derived porosity $\phi$, water saturation $S_w$, and air permeability k. The J-curve correlation presented in a paper by M. C. Leverett entitled "Capillary Behavior in Porous Solids" published in Trans AIME, Vol. 142, pp 151–69, 1941, was developed for unconsolidated sand packs, and was the earliest method proposed to relate laboratory data of capillary pressure $P_c$, water saturation $S_w$, porosity $\phi$ and air permeability k.

Later R. P. Alger, et al. in a paper entitled "New Unified Method of Integrating Core Capillary Pressure Data with Well Logs" and published by SPEFE, pp 145–52 in June 1989 employed a multilinear regression approach to relate these same properties to both core and log data. More recently, D. Smith in an article entitled "How to Predict Down-Dip Water Level" published in World Oil, pp 85–88 in May 1992 predicted the water level from logs with a method for generating synthetic mercury capillary pressure $P_c$ curves if no actual capillary pressure $P_c$ data are available.

The above methods have had only limited success for several reasons. First, laboratory measured capillary pressure data specific to the reservoir are usually not available. Second, to describe the entire reservoir, great care is required for integrating the laboratory capillary pressure data from a few core measurements with log data. Further, if the wells in the reservoir are high above the transition zone, a small error in water saturation produces a large error in the predicted water table. Thus, prior methods are highly sensitive to certain errors that can result in large errors in the predicted water level.

OBJECTS OF THE INVENTION

It is an object of the present invention to provide a method for predicting the hydrocarbon/water contact level in an oil or gas well that may be utilized in the absence of any laboratory data.

A further object of the invention is to provide such a method which simplifies the integration of capillary pressure data $P_c$ with log and core data, and minimizes the error in predicting the hydrocarbon/water contact level in a stratigraphic zone which contains hydrocarbons.

SUMMARY OF THE INVENTION

The method of the present invention is based on a capillary pressure model that relates four quantities: (1) porosity, (2) water saturation, (3) air permeability, and (4) capillary pressure. In the absence of any laboratory capillary pressure $P_c$ data, the model utilizes worldwide correlations from large diverse data bases obtained from sources such as Shell Oil Co. and Amoco Corporation.

The hydrocarbon/water level of a hydrocarbon bearing zone is predicted through regression analysis using porosity $\phi$ and water saturation $S_w$ from log and/or core analysis. As a result of the regression analysis, an error range may be assigned to the predicted water level. As well known, regression is a measure of the extent to which two variables increase together, or the extent to which one variable increases as the other decreases. The regression analysis locates the hydrocarbon/water level that best utilizes all available log and core data in a reservoir. Regression improves the resolution of the prediction by averaging down errors and identifies the error range bounding the predicted water level. The error range is established with a 95% confidence level which means that 95 times out of 100, the actual water level is between the upper and lower limits predicted.

In the regression approach applied, all observed variables are considered to have associated errors. In this case, the observed variables are derived from well log or core analysis information results. At each depth level, there are four observed variables: depth, porosity, water saturation, and air permeability. Although some or all of the last three values may be calculated from logs rather than measured on cores, for the sake of simplicity these values are treated as observations subject to random error. The sum of the weighted squares of these errors is minimized, constrained by derived equations relating the observed values. Thus, more accurate error ranges may be predicted with regression analysis for the determination of hydrocarbon/water contact level.

DESCRIPTION OF THE INVENTION

The advanced capillary pressure method of the present invention utilizes parameters and equations of others in obtaining the model equations utilized in the present invention.

One of these equations was presented in an article by J. H. M. Thomeer entitled "Introduction of a Pore Geometrical Factor Defined by the Capillary Pressure Curve" published by JPT in March 1960, pp 73–77. This article proposed that mercury capillary pressure data be mathematically modelled as hyperbolic curves using the following equation:

$$\frac{S_b}{S_{b^\infty}} = e[-F_g/\log(P_c/P_d)], \tag{1}$$

where $S_{b^\infty}$ is percentage bulk volume of rock occupied by mercury at infinite pressure, $S_b$ is percentage bulk volume occupied by mercury, $F_g$ is a pore geometrical factor, $P_c$ is mercury capillary pressure (psi), and $P_d$ is mercury displacement pressure (psi). However, if it is assumed that $S_{b^\infty}$ is proportional to rock porosity and $S_b$ is proportional to rock porosity times hydrocarbon saturation, then equation (1) may be rewritten in more familiar terms as follows:

$$\log P_c = -F_g/In\ (1-S_w) + \log P_d, \tag{2}$$

where $S_w$ is water saturation.

The simplified equation (2) above adequately represents capillary pressure data, except in complex rocks, where microporosity creates double-humped curves.

Figure 1:
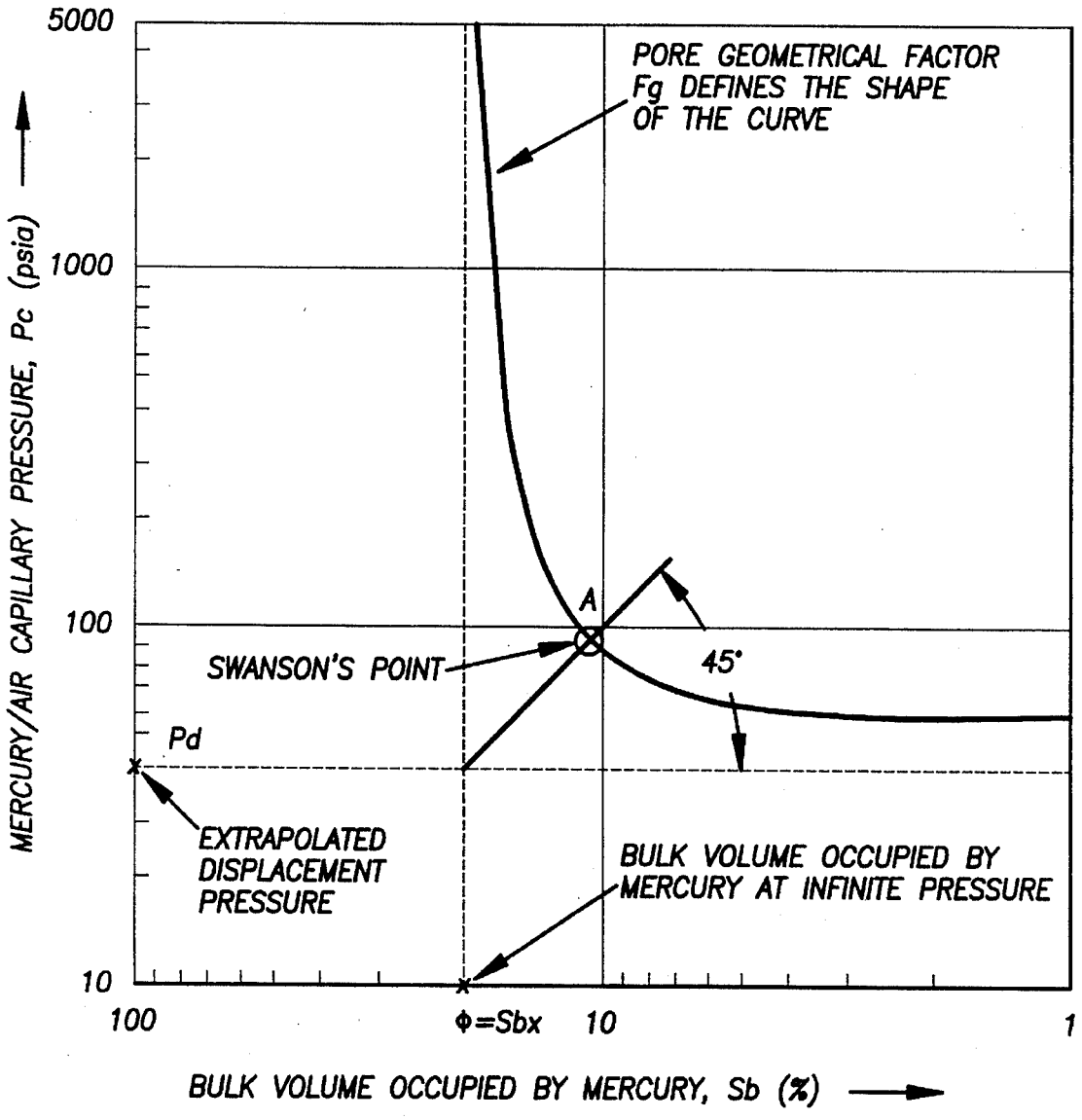
FIG. 1 (PRIOR ART)
FIG. 1 is a graphical representation of a hyperbolic curve for capillary pressure data in accord with an equation developed by J. H. M. Thomeer.
Figure 2:
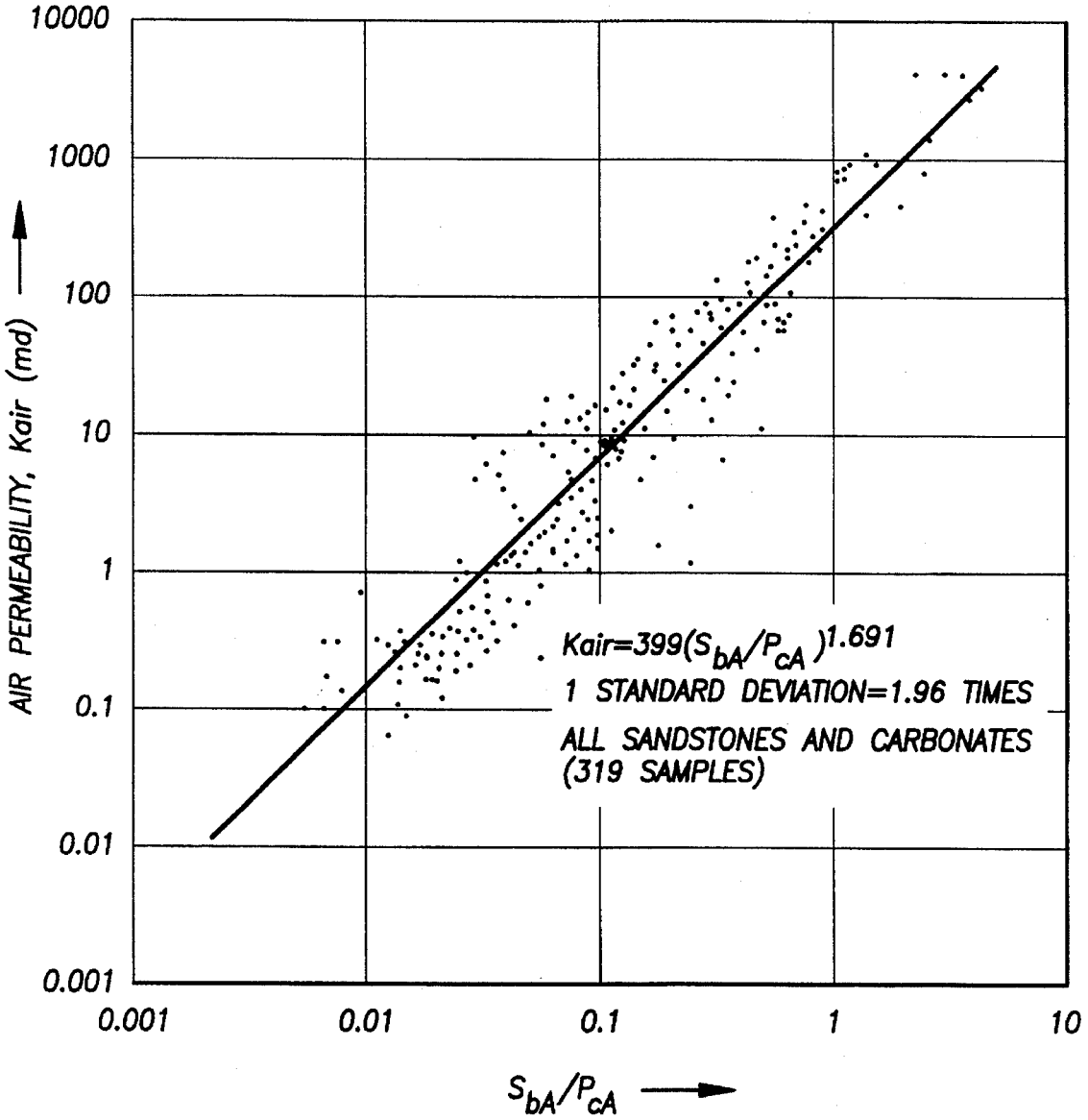
FIG.2 (PRIOR ART)
FIG. 2 is a graphical representation of the correlation between permeabilities and mercury capillary pressures developed by B. F. Swanson and related to point A on the curve of FIG. 1.

An article by B. F. Swanson entitled "A Simple Correlation Between Permeabilities And Mercury Capillary Pressures" published in JPT, December 1981, pp 2,498–2,504, shows that the coordinates from a special point A on the capillary pressure curve developed from equation 1 and illustrated in FIG. 1 of the drawings is related to the permeability of the rock to air, or "air permeability". This relationship is described in the following equation:

$$k_a = 399\left[\frac{\phi\,(1-S_w)_A}{P_{c_A}}\right]^{1.691}, \tag{3}$$

where $k_a$ is air permeability, $\phi$ is porosity of the rock, $S_w$ is water saturation and $P_c$ is mercury capillary pressure with $S_{wA}$ representing water saturation at point A on the curve of FIG. 1 and $P_{c_A}$ representing capillary pressure at point A of the curve shown in FIG. 1. FIG. 2 illustrates the correlation between $k_a$ and $S_{b_a}=\phi(1-S_w)_A$.

The pore geometrical factor, $F_g$, and mercury displacement pressure $P_d$ can be determined from knowledge of water saturation $S_w$ at point A of FIG. 1 and capillary pressure $P_c$ at point A through the relations of equations (4) and (5):

$$F_g = [In\ (1-S_w)_A]^2/2.303 \tag{4}$$

$$P_d = P_{c_A}\ (1-S_w)_A \tag{5}$$

The equations (4) and (5), with that of equation (2) are sufficient to determine the capillary pressure curve of FIG. 1. In other words, information as to the porosity, $P_{cA}$ and $S_{wA}$ is sufficient to define the capillary pressure curve of equation (2).

Equations 4 and 5 show that knowledge of the porosity $\phi$, the capillary pressure at point A of the curve, $P_{cA}$, and the water saturation at point A of the curve, $S_{wA}$, is sufficient to determine the capillary pressure curve of FIG. 1 from equation 2 above.

It is necessary to determine $P_{c_A}$ and $S_{wA}$ in order to obtain the capillary pressure as indicated by the application of equation (2) above. In an article by E. D. Pittman entitled "Relationship of Porosity and Permeability to Various Parameters Derived from Mercury Injection Capillary Pressure Curves for Sandstone" in the AAPG Bulletin, Vol. 42, No. 2, published February 1992, pp 191–198, an equation as set forth below shows a relationship between the pore-throat radius at Point A on FIG. 1 and air permeability in sandstone.

$$\log r_{apex} = -0.226 + 0.4666 \log k_a, \tag{6}$$

where $r_{apex}$ is the pore-throat radius at point A and $k_a$ is air permeability. The relationship set forth in equation (6) was established using multiple regression on data from two hundred and two (202) samples of sandstone from fourteen (14) formations ranging in age from Ordovician to Tertiary.

Figure 3:
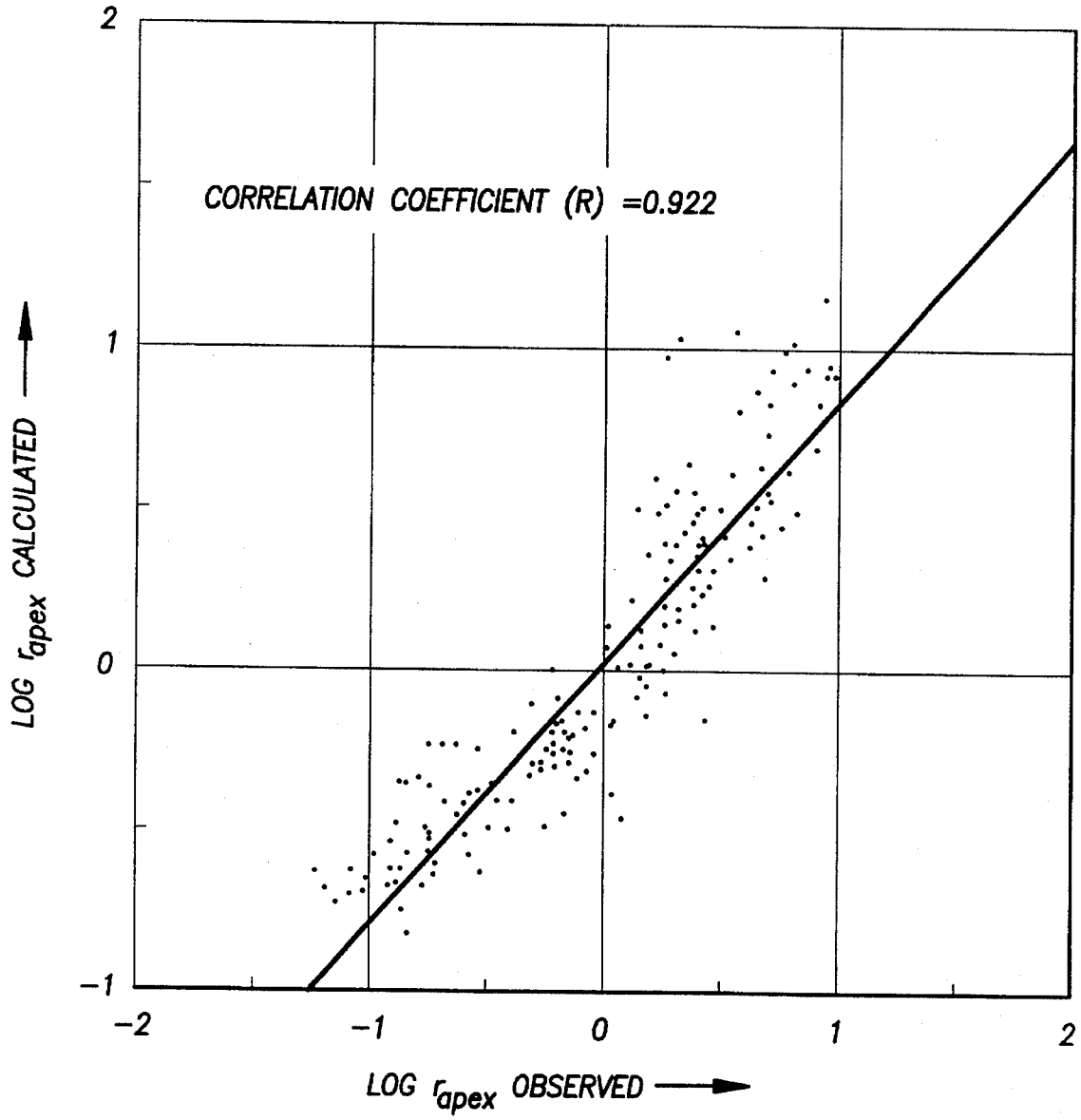
FIG.3 (PRIOR ART)
FIG. 3 is a graphical representation of the relation between pore-throat radius at point A of FIG. 1 and air permeability developed by E. D. Pittman.

The porosities ranged from 3.30 percent to 28 percent, and the permeabilities ranged from 0.05 md to 998 md. The correlation between the calculated pore-throat radius at point A $r_{apex}$ and the observed pore-throat radius is illustrated by the graph in FIG. 3. The capillary pressure $P_c$ at point A on the curve of FIG. 1 may be calculated by converting the pore-throat radius at point A, $r_{apex}$, to mercury capillary pressure $P_c$ by the following equation:

$$P_c = 107/r_{apex} \tag{7}$$

The water saturation $S_w$ may be calculated for point A in terms of porosity $\phi$ and air permeability $k_a$ by first calculating the capillary pressure $P_c$ from air permeability $k_a$ by the following equation:

$$P_c = 180/k_a^{0.466}. \tag{8}$$

Then the capillary pressure calculated from equation (8) above may be substituted in equation (3) above to determine the water saturation $S_w$ at point A in terms of porosity and permeability. Equation (3) as set forth above is:

$$k_a = 399\left[\frac{\phi(1-S_w)_A}{P_{c_A}}\right]^{1.691}. \tag{3}$$

The pore geometrical factor $F_g$ was calculated for equation (4) above and the following equation (9) for pore geometrical factor $F_g$ is derived from equation (4):

$$F_g = \left[\ln\left(5.21\frac{k_a^{0.1254}}{\phi}\right)\right]^2/2.303. \tag{9}$$

Likewise, the mercury displacement pressure $P_d$ was calculated in equation (5) above and the following equation (10) for the mercury displacement pressure $P_d$ is derived from equation (5):

$$P_d = 937.8/(k_a^{0.3406})\phi. \tag{10}$$

The four quantities of porosity $\phi$, water saturation $S_w$, air permeability $k_a$, and capillary pressure $P_c$ have now been related through the several equations (1) through (10) set forth above. The relationship of equations (2), (9), and (10) have been specifically identified for the present invention.

As a relatively large number of core data bases are utilized in the derivation of the capillary pressure curves, a worldwide correlation has been provided. When measured laboratory data is not available, the model derived from the several equations above may be used to provide capillary pressure curves characterizing a reservoir.

Figure 4:
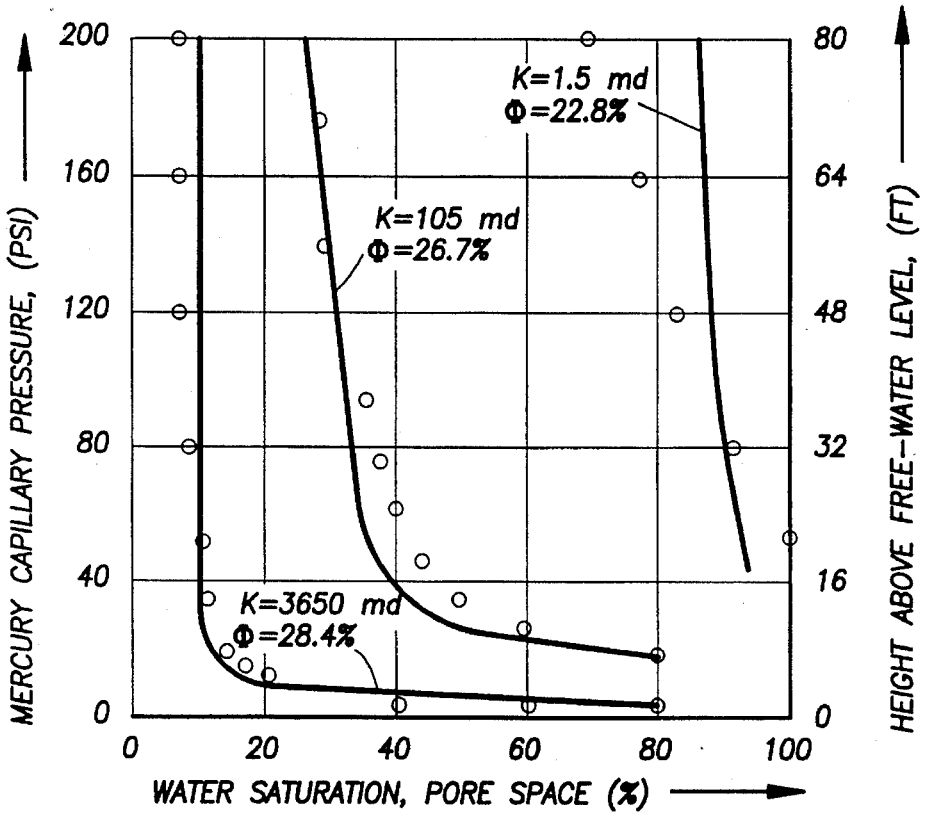
FIG. 4 is a graphical correlation between measured capillary pressure data and capillary pressure data calculated in accord with the present invention.

As illustrated in FIG. 4, three capillary pressure curves derived by the above equations are illustrated for different porosities and permeabilities indicated. The points on the graph of FIG. 4 are plotted from measured capillary pressure data from a Miocene sandstone formation. A very close comparison is obtained in the first curve having a high permeability. The model may be improved from actual capillary pressure data to adjust the constants in equations (9) and (10) as the data becomes available.

For determining, the free-water level or height in a well, the present method is applied to well data, and laboratory capillary pressures are converted to height h above the free-water level by equation (11) as follows:

$$h = \frac{P_c}{0.433\,(p_w - p_h)} \quad \frac{(\sigma_r \cos\theta_r)}{\sigma_i \cos\theta_i} \tag{11}$$

In equation 11, $p_w$=formation water density $p_h$=formation hydrocarbon density $\sigma_r$=interfacial tension between the fluids in the reservoir $\sigma_i$=interfacial tension for mercury in the laboratory $\theta_r$=contact angle between water and reservoir rock $\theta_i$=contact angle between mercury and rock in laboratory The reservoir fluid interfacial tension values are usually not measured but must be obtained form correlations as developed by others. For example, see an article of T. T. Schowalter entitled "Mechanics of Secondary Hydrocarbon Migration and Entrapment" AAPQ Bulletin, Vol. 36, No. 5, published May 1979 pp 723–760.

The model developed by the method of this invention permits the estimation of an error range in the predicted height h of the free-water level. This estimation is based on regression which is a measure of the extent that two variables increase together or of the extent to which one increases as the other decreases. All of the observed variables are considered to have associated errors resulting from logs or core analysis. At each depth level, the four observed variables are (1) depth, (2) porosity, (3) water saturation, and (4) air permeability. All values are treated as observations even though some of the values may be calculated from logs. The equations utilized by the model relating to the observed values constrain or minimize this error.

As a result of regression, error bars or upper and lower estimated water levels are provided as computed by a chi-square distribution using 95% confidence limits. For a large number of trials, the actual water level should be between the upper and lower confidence limits 95 times out of 100. Typical error bars are shown on Table 1 below in which all values are measured in terms of distance below the lowest known hydrocarbon.

TABLE 1

TYPICAL ERROR BARS FOR FREE-WATER LEVEL PREDICTIONS
Distance below lowest known oil

| Predicted free-water level, ft. | Upper confidence limit, ft. | Lower confidence limit, ft. |
|---|---|---|
| 10 | 6 | 17 |
| 100 | 60 | 170 |

The resolution of the method is improved if the logged pay interval contains the transition zone rather than being high above the water level on the steep part of the capillary pressure curve.

Figure 6:
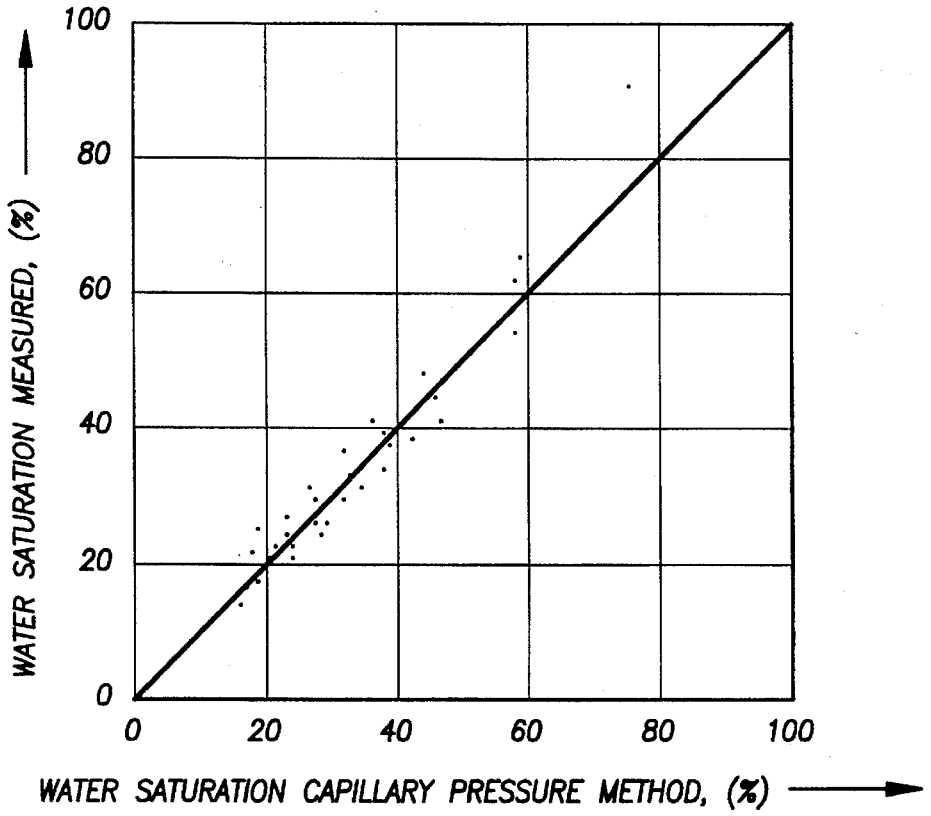
FIG. 6 is a graphical correlation between water saturations calculated from the present invention compared against measured water saturation from five cores of the Indonesian well illustrated in FIG. 5.
Figure 5:
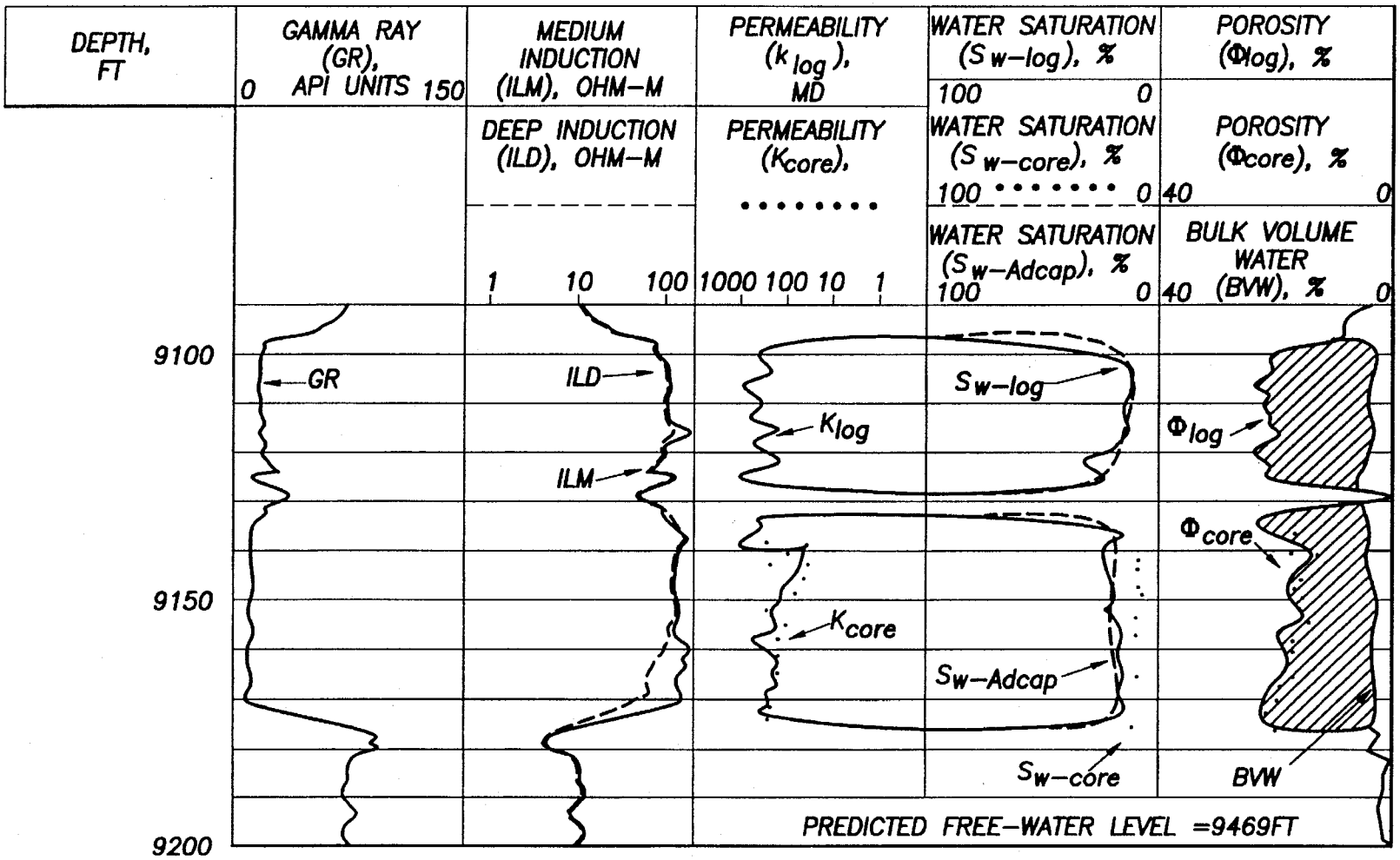
FIG. 5 is a representation of a log of a clean gas sand in an Indonesian well.

Indonesian Well—FIGS. 5 and 6

FIG. 5 illustrates the log of a clean gas sand in an Indonesian well. A conventional core cut in the bottom half of the sand in oil-base mud shows good porosities, high permeabilities, and low water saturations. The log derived porosities and water saturations were in fairly close correlation with the values obtained by laboratory core analysis. Permeability was calculated from log derived porosity by a correlation designed to maximize agreement with core permeability.

Laboratory measured centrifuge capillary pressure data were available from five cores. Using such data, the coefficients for equations (9) and (10) in the standard model were adjusted to correlate to the measured data from the cores. Equations (9) and (10) adjusted with such data produce local model equations (12) and (13) as follows:

$$F_g = \left[ \ln\left( 3.1 \frac{k_a^{0.1254}}{\phi} \right) \right]^2 / 2.303, \tag{12}$$

$$P_d = 177/(k_a^{0.3406}\,\phi). \tag{13}$$

The coefficient in equation (9) is 5.21 whereas the corresponding coefficient in equation (12) is 3.1. The coefficient in equation (10) is 937.8 whereas the corresponding coefficient in equation (13) is 177. Thus, equations (12) and (13) represent the local model for the Indonesian reservoir.

FIG. 6 also represents the Indonesian well and shows a very close correlation between the water saturations calculated from the equations of the model and the water saturations as measured from the five core samples in the laboratory utilizing the centrifuge. The conversion of capillary pressure $P_c$ to height h is provided by the following equation (14):

$$h = 0.37\,P_c \tag{14}$$

The free-water level was predicted with two different data sets for possible comparison while utilizing the local model for the Indonesian well developed in equations (12) and (13) along with equation (2). For the first set of data, core analysis values for porosity, permeability, and water saturation were entered into the regression at each core plug depth. Based on these values and equations (2), (12), (13), and (14), a free-water level h was predicted 409 feet below the sand base with relatively large error bars. The upper error bar or limit was 56 feet below the sand base.

For the second data set, the porosity, water saturation and air permeability values were derived from a log analysis. Based on these values, a free-water level h was predicted 294 feet below the sand base which was 9,469 feet as illustrated on the log shown in FIG. 5. The error range or error bars were substantially smaller than the error range for the first data set and the upper error range was 134 feet below the sand base. Thus, on the basis of the error range, the free-water level predicted by the log analysis data set is preferred.

A log from a downdip well in the Indonesian reservoir showed a hydrocarbon-water contact 200 feet below the base of the sand as illustrated in FIG. 5. The previous water level predictions from the first data set and the second data set are generally in qualitative agreement with the previous predictions.

When the free-water level is found, this known value may then be utilized to calculate the water saturation at any height in the reservoir. As illustrated in FIG. 5 from the known free-water level as found in the downdip well, water saturation was calculated within the well shown in FIG. 5 and shown on the curve of FIG. 5. The curve indicated a fair to good correlation with the log derived water saturations, except in intervals where the induction resistivity is reduced by thin bed or shoulder bed effects.

Figure 7:
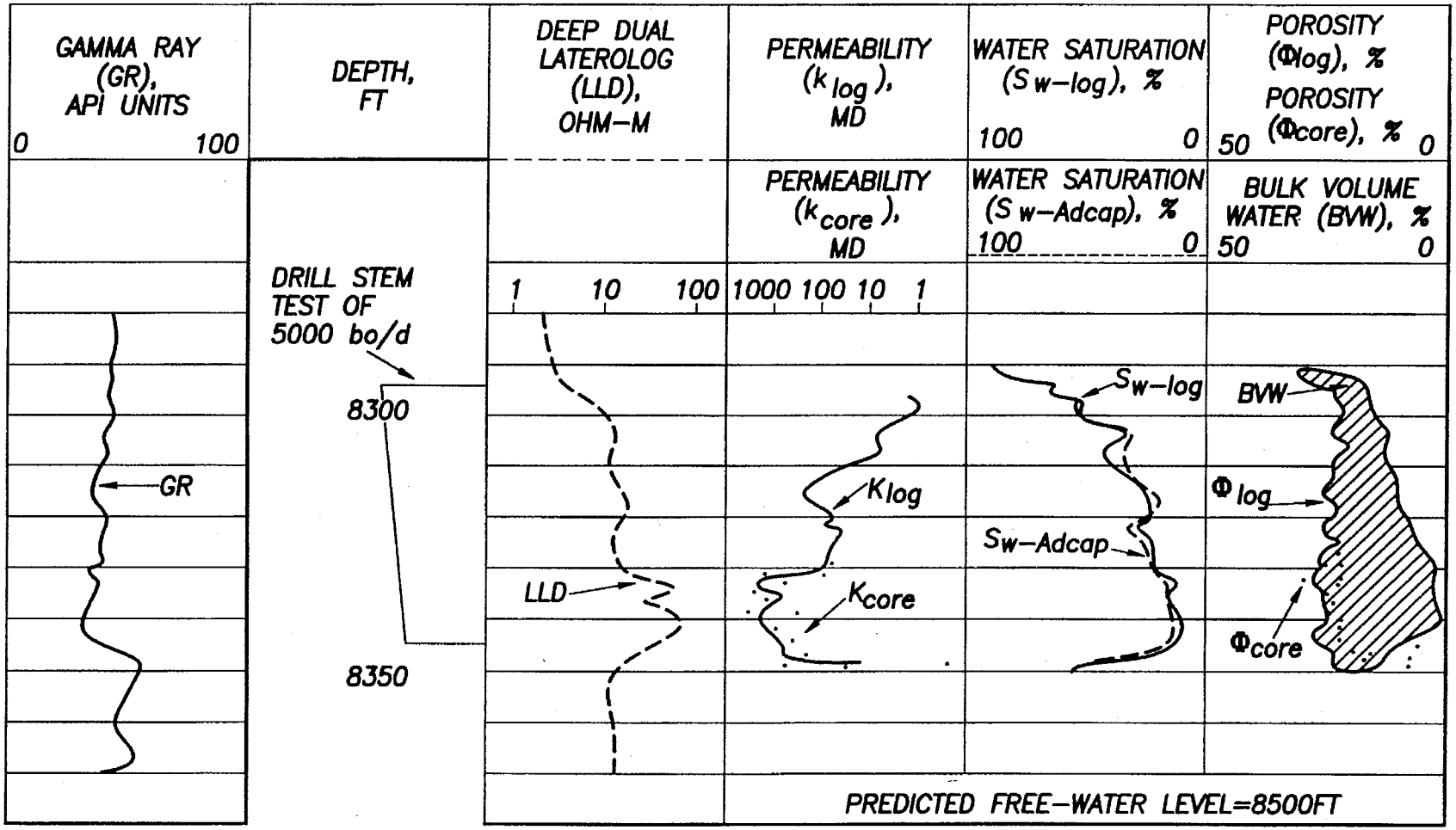
FIG. 7 is the representation of a log in a well offshore of the Ivory Coast, Africa.

Offshore Ivory Coast African Well—FIG. 7

FIG. 7 illustrates the log of an oil sand in a well offshore of Ivory Coast, Africa. The resistivity and gamma ray logs show a clean sandstone at the base of the well with a fining upward sequence. Conventional core data at the sand base showed excellent porosity and air permeability. Pressure buildup analysis indicated a kh value of 13,272 md—ft from a drill stem test that flowed 5,000 bo/d. No laboratory measured capillary data were available and prior equations (2), (9) and (10) as set forth below were used for water level prediction.

$$\log P_c = -F_g/\ln(1 - S_w) + \log P_d \quad (2)$$

$$F_g = \left[ \ln\left( 5.21 \frac{k_a^{0.1254}}{\phi} \right) \right]^2 / 2.303 \quad (9)$$

$$P_d = 937.8/(k_a^{0.3406})\,\phi \quad (10)$$

For the reservoir fluids present equation (11 ) reproduced again here was used to find the relation $h=0.64P_c$.

$$h = \frac{P_c}{0.433\,(p_w - p_h)} \quad \frac{(\sigma_r \cos\theta_r)}{\sigma_i \cos\theta_i} \quad (11)$$

Log data entered into the regression comprised foot by foot values for porosity, water saturation, and permeability for a 52 foot sandstone interval. Permeability values were calculated from porosity and shaliness using an empirical equation calibrated to the core permeabilities. Based on the above data, the predicted water level h was at 8,500 feet as shown in FIG. 7, or 152 feet below the lowest known oil. The error bars range from 127 feet to 184 feet below the lowest known oil. The water level has not yet been confirmed by a well, but supporting data including a structure map from existing well control and 3-dimensional seismic show a spill point at the predicted water level.

Water saturation was calculated from the predicted free-water level. The water saturations calculated from the predicted free-water level were closely correlated to resistivity based water saturations as shown in FIG. 7. This confirms the method of this invention in relation to the petrophysical data.

Other Test Cases

Water level predictions according to the present invention have been made in other wells. Listed in Table 2 below are water level predictions from seven different reservoirs or fields. One of the fields, Boomerang, is a limestone reservoir while the other six are sandstone reservoirs.

TABLE 2

FREE-WATER LEVEL PREDICTIONS CONFIRMED BY OTHER DATA
Distance below lowest known oil

| Field | Data | Predicted free-water level, ft. | Known limits, ft. | Control for known limits |
|---|---|---|---|---|
| Boomerang Strawn (oil) Kent Co., Tex. | Crestal well Log, conventional core | 22 | 10 | Accepted oil/water contact |
| Stratton D-35 Frio (gas) Kleberg Co., Tex. | Crestal well Log, conventional core, capillary pressure data | 6 | 11 | Gas/water contact by logs and production tests |
| Lake Creek G-2 Wilcox (gas) Mont. Co., Tex. | Crestal well Log, conventional core, capillary pressure data | 61 | 51 | Lowest known gas from downdip log |
| Unnamed Miocene (oil) Offshore Louisiana | Discovery well Log, side wall cores, pressure buildup | 16 | 16 | Highest known water on log. Well cut water after 3 months |
| Unnamed Miocene (oil) Offshore Louisiana | Discovery well Log, side wall cores, pressure buildup | 11 | 16 | Highest known water on log. Well cut water after 6 months |
| Unnamed Miocene (gas) Indonesia | Crestal well Log, conventional core, capillary pressure data | 294 | 200 | Gas/water contact from downdip log |
| Unnamed Cretaceous (oil) Offshore Africa | Delineation well Log, conventional core, pressure buildup | 150 | 150 | Structure map spill point |

Air permeability ranges from low at Lake Creek field and Stratton field to high in the other four sandstone reservoirs. Three reservoirs, Stratton, Lake Creek, and the unnamed Indonesian reservoir, had capillary pressure $P_c$ data, and equations (9) and (10) were modified to provide a local model for the water level predictions. The remaining four fields utilized the standard model with equations (4), (9), and (10) to predict the free-water level. Fair to good correlations were shown between the free-water level predictions from the standard model and the free-water level predictions calculated from additional data including the capillary pressure $P_c$ data.

The present method of this invention is particularly adapted for use with clastic reservoirs as some of the data utilized in the several equations employed related to sandstone. However, it is believed that the present method may be utilized in other formations, such as carbonates particularly for intercrystalline, intergranular, or interparticle-type textures.

In sandstone reservoirs, porosities have generally exceeded 12 percent. Some applications of the present method have been in low porosity sandstones (4–10%) and satisfactory results have been obtained in the prediction of free-water levels when calibrated with capillary pressure data from specific reservoir rock. For best results in low porosities, capillary pressures should be measured with the cores at reservoir stress. It is noted that when the free-water level is known, the present method can calculate water saturation at any height of the reservoir. These water saturation levels may be compared against resistivity-based water saturations using the standard model. If a relatively close correlation is not obtained, then the model should be adjusted for suitable correlation.

While the method establishing the standard model for this invention has been utilized primarily for the location of free-water levels, if any three of the four basic quantities, porosity, air permeability, water saturation, and capillary pressure are known, then the remaining quantity can be calculated. For example, if the water level is known and the values for porosity and permeability are available, then a water saturation profile can be derived as illustrated by the above case histories of the Indonesian and African wells. The values for water saturations independent of the induction log are particularly useful where sands are thinly laminated with shales.

Another useful application of the method of this invention is the calculation of permeability values when the values for water level, porosity and water saturation are known. In the Lake Creek field set forth in Table 2 above, an effective gas permeability was calculated from the values of water level, porosity, and water saturation. This permeability compared favorably with permeability derived from well tests as indicated in Table 3 below.

TABLE 3

PERMEABILITY COMPARISON

| Pressure buildup, md-ft | Capillary pressure method, md-ft |
|---|---|
| 1.3 | 1.66 |
| 51.0 | 9.28 |
| 12.6 | 2.51 |
| 21.0 | 18.33 |
| 8.0 | 17.65 |

Equations (1) through (12) listed above are compiled below in Tables 4 and 5 for easy reference together with a definition of the symbols used in the equations.

TABLE 4

EQUATIONS

| | |
|---|---|
| Equation (1) | $\frac{S_b}{S_{b\infty}} = e^{-F_g/\log(P_c/P_d)}$ |
| Equation (2) | $\log P_c = -F_g/\ln(1 - S_w) + \log P_d$ |
| Equation (3) | $k_a = 399\left[\frac{\phi(1 - S_w)_A}{P_{c_A}}\right]^{1.691}$ |
| Equation (4) | $F_g = [\ln(1 - S_w)_A]^2/2.303$ |
| Equation (5) | $P_d = P_{c_A}(1 - S_w)_A$ |
| Equation (6) | $\log r_{apex} = -0.226 + 0.466 \log k_a$ |
| Equation (7) | $P_c = 107/r_{apex}$ |
| Equation (8) | $P_c = 180/k_a^{0.466}$ |
| Equation (9) | $F_g = \left[\ln\left(5.21\frac{k_a^{0.1254}}{\phi}\right)\right]^2/2.303$ |
| Equation (10) | $P_d = 937.8/(k_a^{0.3406})\,\phi$ |
| Equation (11) | $h = \frac{P_c}{0.433(p_w - p_h)}\left(\frac{\sigma_r\cos\theta_r}{\sigma_i\cos\theta_i}\right)$ |

TABLE 4-continued

EQUATIONS

| | |
|---|---|
| Equation (12) | $F_g = \left[\ln\left(3.1\frac{k_a^{0.1254}}{\phi}\right)\right]^2/2.303$ |
| Equation (13) | $P_d = 177/(k_a^{0.3406}\,\phi)$ |
| Equation (14) | $h = 0.37\,P_c$ |

where:
$F_g$ = Pore geometrical factor, dimensionless
$r_{apex}$ = Pore-throat radius at Point A, μm
h = Height above free-water level, ft.
$k_a$ = Air permeability, md
$P_c$ = Mercury capillary pressure, psi
$P_d$ = Mercury displacement pressure, psi
$S_b$ = Bulk volume occupied by mercury, %
$S_{b\infty}$ = Bulk volume occupied by mercury at infinite pressure, %
$S_w$ = Water saturation, fraction
$\theta_r$ = Contact angle between the water and the reservoir rock (typically 0°)
$\theta_i$ = Contract angle between mercury and rock in the laboratory (140°)
$p_w$ = Formation water density, g/ml
$p_h$ = Formation hydrocarbon density, g/ml
$\sigma_i$ = Interfacial tension for mercury in the laboratory, 480 dynes/cm
$\sigma_r$ = Interfacial tension between the fluids in the reservoir, dynes/cm
$\phi$ = Porosity, %

As indicated above, equations (2), (9), and (10) were specifically derived for the present invention and may be used when laboratory measured capillary pressure data specific to a reservoir are not available. Water levels are predicted through regression analysis with error ranges being predicted also. In the event laboratory measured capillary pressure data specific to a reservoir are available, the constants in equations (9) and (10) are adjusted as indicated by equations (12) and (13).

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A method for determining the hydrocarbon/water contact level h in a permeable zone of a well comprising the steps of:

transforming signals characteristic of formations pierced by a well into signals as a derived function of depth x in the well, of porosity, $\phi(x)$, water saturation, $S_w(x)$, and air permeability, $k_a(x)$, transforming said signals representative of porosity, water saturation, and air permeability into a signal representative of the hydrocarbon/water contact level h by regression which minimizes within a predetermined confidence limit the error in h, where porosity, air permeability, and water saturation are considered to have associated errors, where such transformation is through a predetermined relationship of $h=f(\phi(x), k_a(x), S_w(x))$, with said predetermined relationship $h=f(\phi(x), k_a(x), S_w(x))$ characterized by the relationships, $$P_d(x) = k_3/(k_a(x)^{k4})\,\phi(x), \text{ where}$$
$$k_3 = 937.8, \text{ and}$$
$$k_4 = 0.3406$$

-continued $$F_g(x) = \left[ \ln\left( k_1 \left( \frac{k_a(x)^{k2}}{\phi(x)} \right) \right) \right]^2 / 2.303$$

$k_1 = 5.21$, and $k_2 = 0.1254$;

$\log P_c(x) = -F_g(x)/\ln(1 - S_w(x) + \log P_d(x)$; and $h = k_5 p_c(x)$, where $$k_5 = \frac{1}{.433(P_w - P_h)} \left[ \frac{\sigma_r \cos\theta_r}{\sigma_i \cos\theta_i} \right]$$

$p_w$=formation water density $p_h$=formation hydrocarbon density $\sigma_r$=interfacial tension between the fluids in said zone $\sigma_i$=interfacial tension for mercury in a laboratory test, $\theta_r$=contact angle between formation water and reservoir rock, and $\theta_i$=contact angle between mercury and rock, in the laboratory.

2. The method of claim 1 further comprising the steps of:

transforming said hydrocarbon/water contact level h into a synthectic estimated water saturation log, $S_{w\ cst}(x)$ as a function of depth x using said predetermined relationship with $h_{cst}=f(\phi(x), k_a(x), S_{w\ cst}(x))$, transforming said log derived water saturation $S_w(x)$ log and said estimated water saturation $S_{w\ cst}(x)$ log into a compound graph with $S_w(x)$ and $S_{wcst}(x)$ overlaying each other whereby as a function of depth x, a user may asses the fit of $S_w(x)$ and $S_{w\ cst}(x)$ logs in order to asses the accuracy of said level $h_{cst}$ at said hydrocarbon/water contact level.

3. The method of claim 1 further comprising the step of:

determining an upper and lower estimate of hydrocarbon/water contact level h for said permeable zone.

* * * * *